US007081910B2

(12) United States Patent
Gao et al.

(10) Patent No.: US 7,081,910 B2
(45) Date of Patent: Jul. 25, 2006

(54) PREVENTING CREASE FORMATION IN DONOR WEB IN DYE TRANSFER PRINTER THAT CAN CAUSE LINE ARTIFACT ON PRINT

(75) Inventors: Zhanjun Gao, Rochester, NY (US); Po-Jen Shih, Webster, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/812,547

(22) Filed: Mar. 29, 2004

(65) Prior Publication Data

US 2004/0218030 A1 Nov. 4, 2004

Related U.S. Application Data

(63) Continuation-in-part of application No. 10/426,591, filed on Apr. 30, 2003, now Pat. No. 6,768,503.

(51) Int. Cl.
*B41J 2/32* (2006.01)

(52) U.S. Cl. ..... 347/171

(58) Field of Classification Search ..... 347/171, 347/197–198, 215, 217–220; 400/661.3, 400/648, 659, 234, 662

See application file for complete search history.

(56) References Cited

U.S. PATENT DOCUMENTS 6,757,003 B1 * 6/2004 Gao et al. ..... 347/220

FOREIGN PATENT DOCUMENTS

| | | | |
|---|---|---|---|
| JP | 59-68282 | | 4/1984 |
| JP | 60-157889 | | 8/1985 |
| JP | 60184864 | * | 9/1985 |
| JP | 07-178993 | | 7/1995 |

* cited by examiner

*Primary Examiner*—K. Feggins
(74) *Attorney, Agent, or Firm*—Mark G. Bocchetti

(57) ABSTRACT

A thermal printer is adapted to prevent crease formation in successive dye transfer areas of a dye donor web that can cause line artifacts to be printed on a dye receiver during dye transfer from each dye transfer area to the dye receiver in a dye transfer printer.

15 Claims, 12 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATION

This application is a continuation-in-part of commonly assigned, application Ser. No. 10/426,591, entitled PREVENTING CREASE FORMATION IN DONOR WEB IN DYE TRANSFER PRINTER THAT CAN CAUSE LINE ARTIFACT ON PRINT, and filed Apr. 30, 2003 now U.S. Pat. No. 6,768,503 in the names of Po-Jen Shih, Zhanjun J. Gao, and Robert F. Mindler.

FIELD OF THE INVENTION

The invention relates generally to dye transfer or thermal printers. More particularly, the invention relates to the problem of creases or wrinkles being formed in the dye transfer areas of a dye donor web during dye transfer printing. Crease formation in a dye transfer area can result in an undesirable line artifact being printed on a dye receiver.

BACKGROUND OF THE INVENTION

A typical multi-color dye donor web that is used in a dye transfer or thermal printer is substantially thin and has a repeating series of three different rectangular-shaped color sections or patches such as a yellow color section, a magenta color section and a cyan color section. In addition, there may be a transparent colorless laminating section immediately after the cyan color section.

Each color section of the dye donor web consists of a dye transfer area which is used for dye transfer printing and a pair of opposite longitudinal edge areas alongside the dye transfer area which often are not used for printing. The dye transfer area may be about 152 mm wide and the two longitudinal edge areas may each be about 5.5 mm wide, so that the total web width is approximately 163 mm.

To make a multi-color image print using a thermal printer, a motorized donor web take-up spool draws a longitudinal portion of the dye donor web off a donor web supply spool in order to successively move an unused single series of yellow, magenta and cyan color sections over a stationary liner array (bead) of selectively heated resistive elements on a thermal print head between the supply and take-up spools. Respective color dyes within the yellow, magenta and cyan color sections are successively heat-transferred line-by-line, via the selectively heated resistive elements, onto a dye receiver medium such as a paper or transparency sheet or roll, to form the color image print. The selectively heated resistive elements often extend across the entire width of a color section, i.e. across the dye transfer area and the two longitudinal edge areas comprising that color section. However, only those resistive elements that contact the dye transfer area are selectively heated. Those resistive elements that contact the two longitudinal edge areas are not heated. Consequently, the dye transfer occurs from the dye transfer area to the dye receiver medium, but not from the two longitudinal edge areas to the dye receiver medium.

As each color section is drawn over the selectively heated resistive elements, it is subjected to a longitudinal tension particularly by the forward pulling force of the motorized donor web take-up spooi. Since the dye transfer area in the color section is heated by the resistive elements, but the two longitudinal edge areas alongside the dye transfer area are not, the dye transfer area is significantly weakened and therefore is vulnerable to being longitudinally stretched as compared to the two edge areas. Consequently, the longitudinal tension will stretch the dye transfer area relative to the two longitudinal edge areas. This stretching causes the dye transfer area to become thinner than the non-stretched edge areas, which in turn causes some creases or wrinkles to develop in the dye transfer area, most acutely in those regions of the dye transfer area that are close to the non-stretched longitudinal edge areas. The creases or wrinkles occur most acutely in the regions of the dye transfer area that are close to the non-stretched edge areas because of the sharp, i.e. abrupt, transition between the stretched (thinner) transfer area and the non-stretched (thicker) edge areas.

As the dye donor web is pulled by the motorized donor web take-up spool over the selectively heated resistive elements, the creases or wrinkles tend to spread from a trailing (rear) end portion of a used dye transfer area at least to a leading (front) end portion of the next dye transfer area to be used. A known problem that can result is that the creases in the leading (front) end portion of the next dye transfer area to be used will cause undesirable line artifacts to be printed on a leading (front) end portion of the dye receiver medium. The line artifacts printed on the dye receiver medium, although they may be relatively short, are quite visible.

The question presented therefore is how to solve the problem of the creases or wrinkles being created in an unused dye transfer area so that no line artifacts are printed on the dye receiver medium during the dye transfer.

The Cross-Referenced Application

The cross-referenced application discloses a thermal printer capable of preventing crease formation in successive dye transfer areas of a dye donor web that can cause line artifacts to be printed on a dye receiver during dye transfer from each dye transfer area to the dye receiver. To prevent crease formation, there is provided a crease-preventing roller for supporting a dye transfer area of the dye donor web and two edge areas of the dye donor web alongside the dye transfer area. The roller has respective helical ribs that spiral inwardly from coaxial opposite ends of the roller and that are resilient to be deformed towards the opposite ends of the roller due to longitudinal tensioning of the dye transfer area and two edge areas. When deformed, the ribs urge the dye transfer area and two edge areas to spread in opposition to crease formation during dye transfer from the dye transfer area to the dye receiver. Thus, crease formation can be prevented even though the dye transfer area is heated by the print head, but the two edge areas are not.

SUMMARY OF THE INVENTION

According to one aspect of the invention, a thermal printer capable of preventing crease formation in successive dye transfer areas of a dye donor web that can cause line artifacts to be printed on a dye receiver during dye transfer from each dye transfer area to the dye receiver, comprises:

a thermal print head for heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and a crease-preventing roller for supporting at least the dye transfer area and two edge areas, having an elastic cover layer that can be stretched towards coaxial opposite ends of the roller to spread at least the regions of the dye transfer area in which crease formation can occur in order to oppose crease formation, and having respective movable members (such as the helical ribs in the cross-referenced application) moving to stretch the elastic cover layer towards the opposite ends of the roller.

The addition of the elastic cover layer to the crease-preventing roller (as compared to the crease-preventing roller without the elastic cover layer in the cross-referenced application) ensures a uniform contact of the roller with the dye transfer area and two edge areas.

According to another aspect of the invention, a method in a thermal printer of preventing crease formation in successive dye transfer areas of a dye donor web that can cause line artifacts to be printed on a dye receiver during dye transfer from each dye transfer area to the dye receiver, comprises:

heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and stretching an elastic cover layer on a crease-preventing roller that supports at least the dye transfer area and two edge areas towards the opposite ends of the roller, so that the elastic cover layer spreads at least the regions of the dye transfer area in which crease formation can occur in order to oppose crease formation.

DETAILED DESCRIPTION OF THE INVENTION

Dye Donor Web

Figure 1:
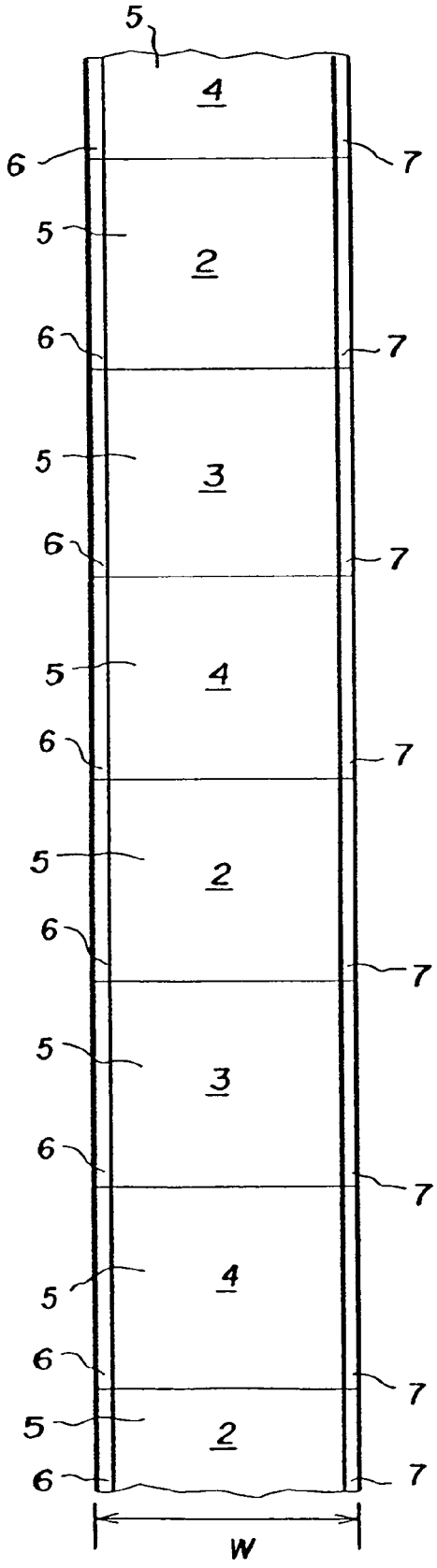
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a dye transfer or thermal printer. The dye donor web 1 is substantially thin and has a repeating series (only two completely shown) of three different rectangular-shaped color sections or patches such as a yellow color section 2, a magenta color section 3 and a cyan color section 4. In addition, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 which is used for printing and a pair of similar-colored opposite longitudinal edge areas 6 and 7 alongside the dye transfer area which often are not used for printing. Preferably, the dye transfer area 5 is about 152 mm wide and the two edge areas 6 and 7 are each about 5.5 mm wide, so that the total web width W is approximately 163 mm.

Dye Transfer or Thermal Printer

FIGS. 2–6 depict operation of a dye transfer or thermal printer 10 using the dye donor web 1 shown in FIG. 1 to effect successive yellow, magenta and cyan dye transfers onto a known dye receiver sheet 12 such as paper or a transparency.

Initialization

Figure 2:
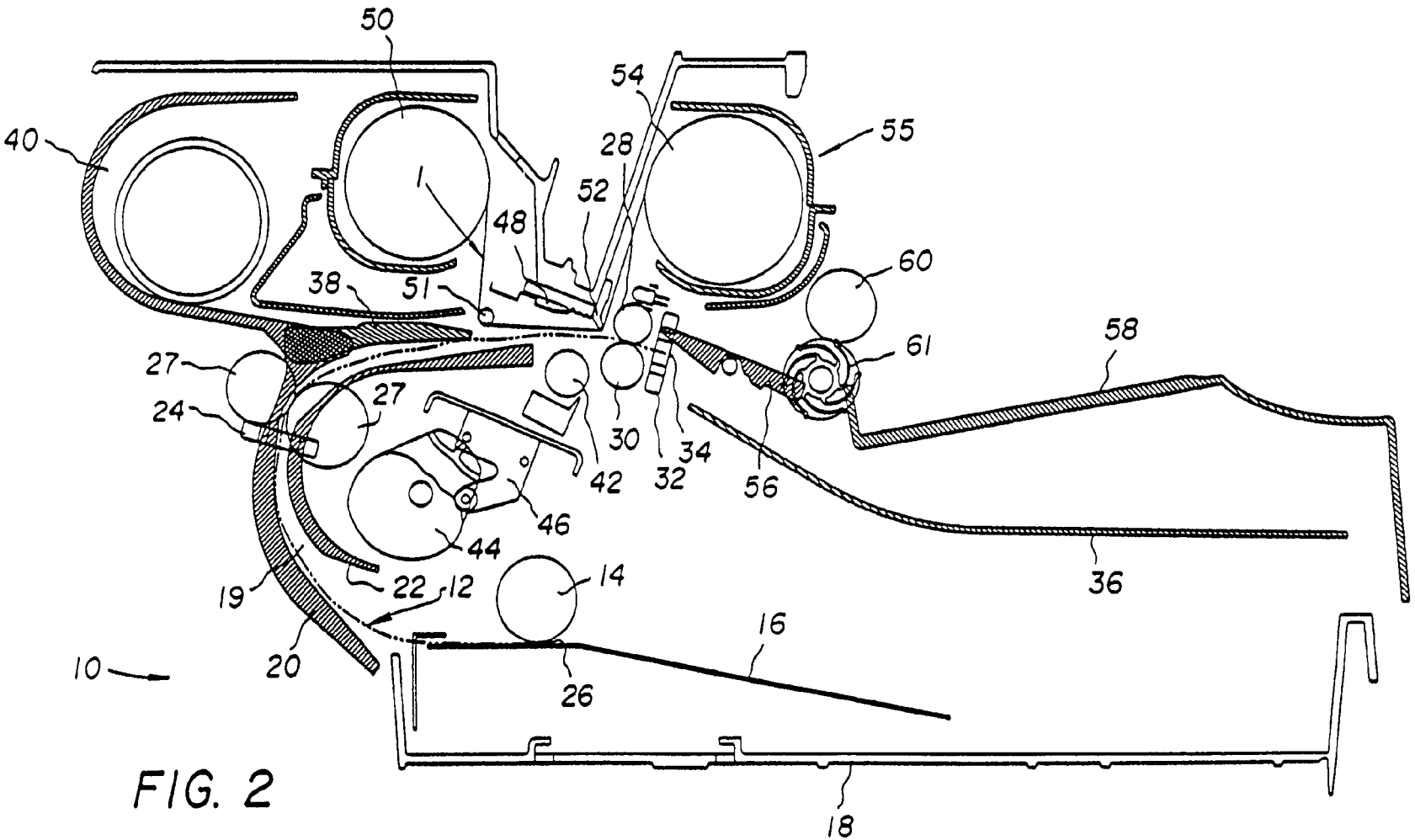
FIG. 2 is an elevation view, partly in section, of a dye transfer or thermal printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing (rear) edge 26 of the dye receiver sheet 12, it activates at least one of pair of motorized parallel-axis urge rollers 27, 27 in the channel 19. The activated rollers 27, 27 then advance the dye receiver sheet 12 forward (to the right in FIG. 2) through the nip of a motorized capstan roller 28 and a pinch roller 30, positioned beyond the channel 19, and to a leading (front) edge sensor 32.

Figure 3:
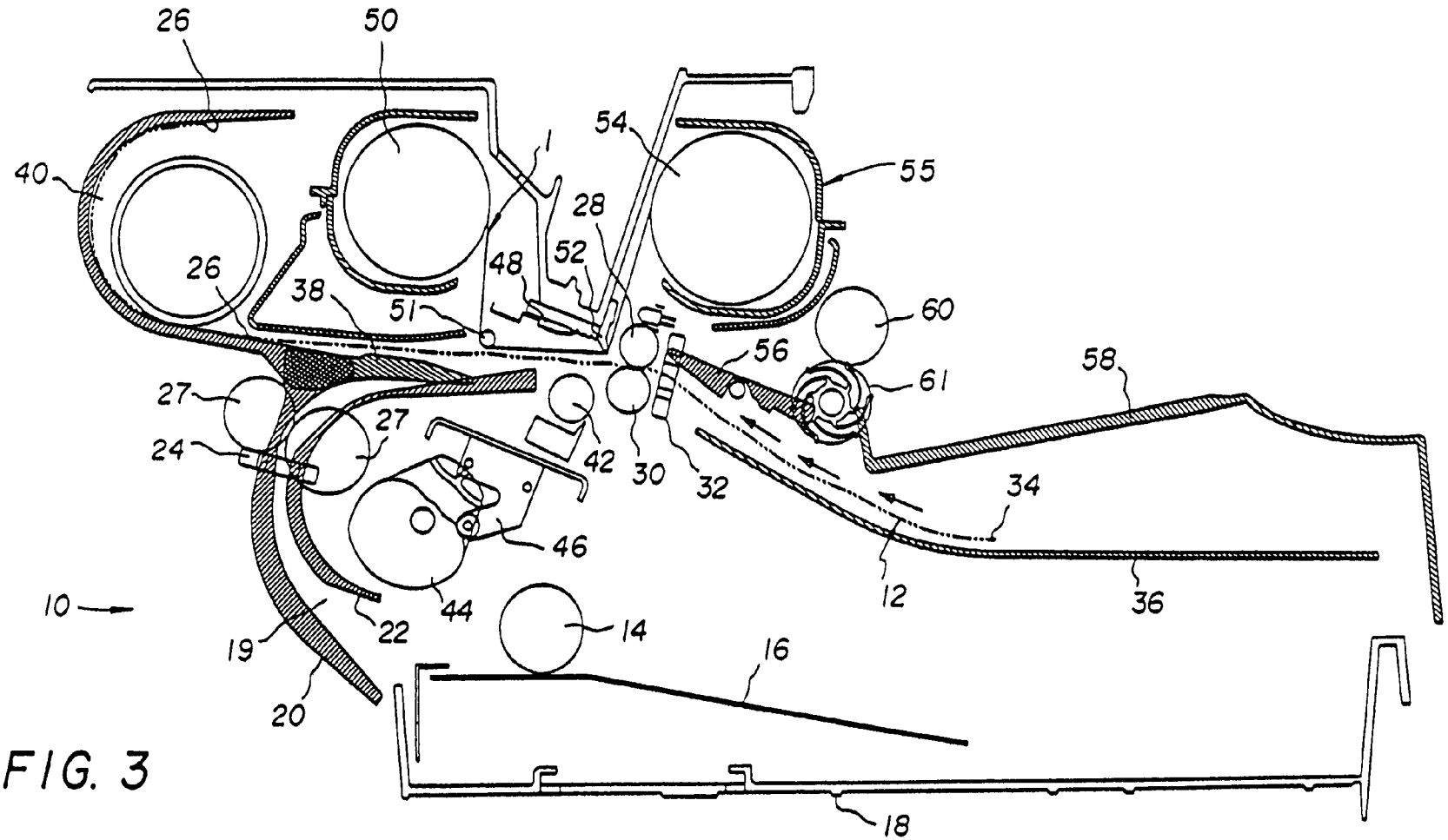
FIGS. 3 and 4 are elevation views, partly in section, of the dye transfer printer, showing successive dye transfer cycles during the printer operation.

In FIG. 3, the leading edge sensor 32 has sensed a leading (front) edge 34 of the dye receiver sheet 12 and activated the motorized capstan roller 28 to cause that roller and the pinch roller 30 to advance the dye receiver sheet forward partially onto an intermediate tray 36. The dye receiver sheet 12 is advanced forward onto the intermediate tray 36 so that the trailing (rear) edge 26 of the dye receiver sheet can be moved beyond a hinged exit door 38 that is a longitudinal extension of the curved guide 20. Then, as illustrated, the hinged exit door 38 closes and the capstan and pinch rollers 28 and 30 are reversed to advance the dye receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
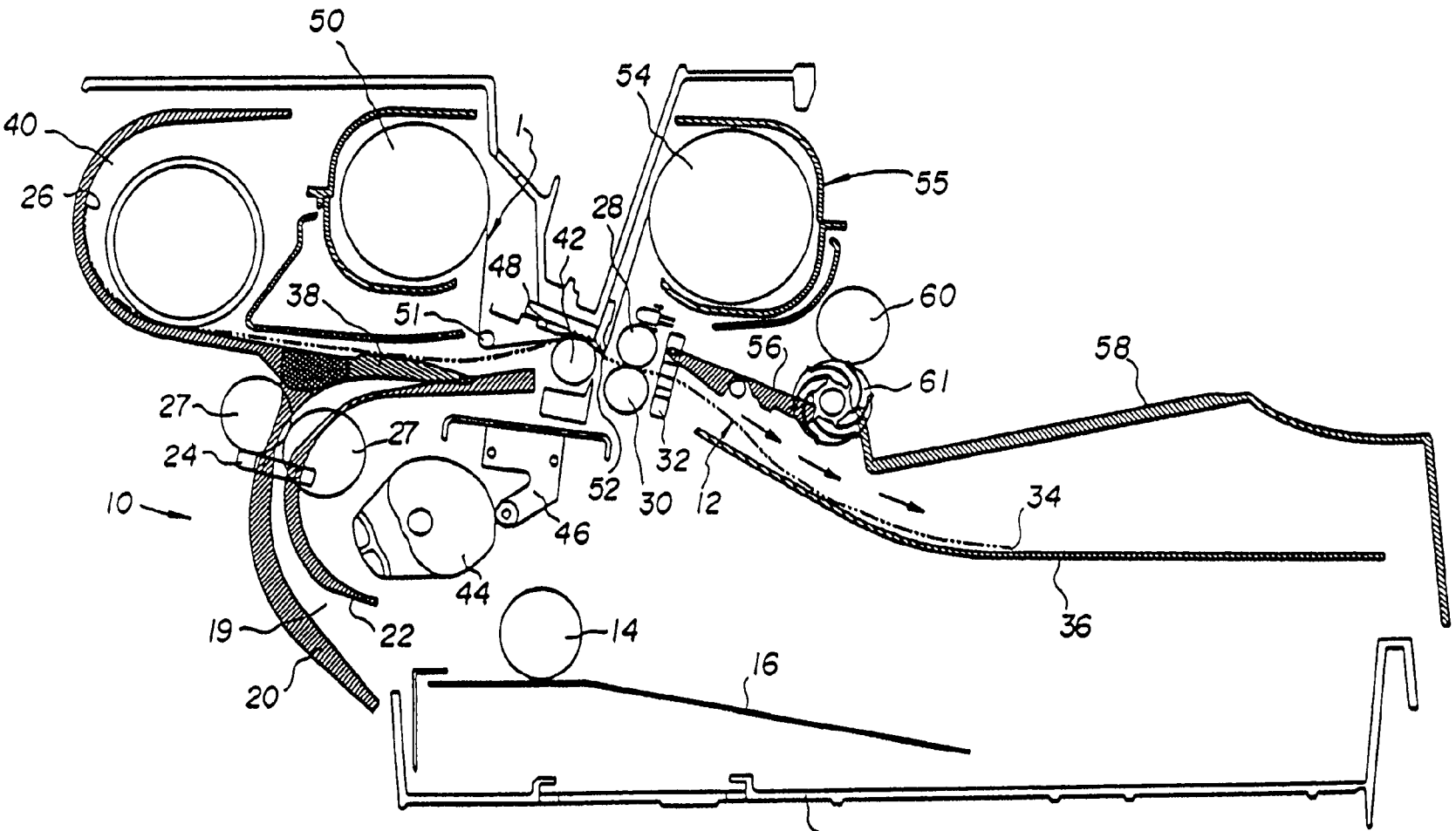
Figure 5:
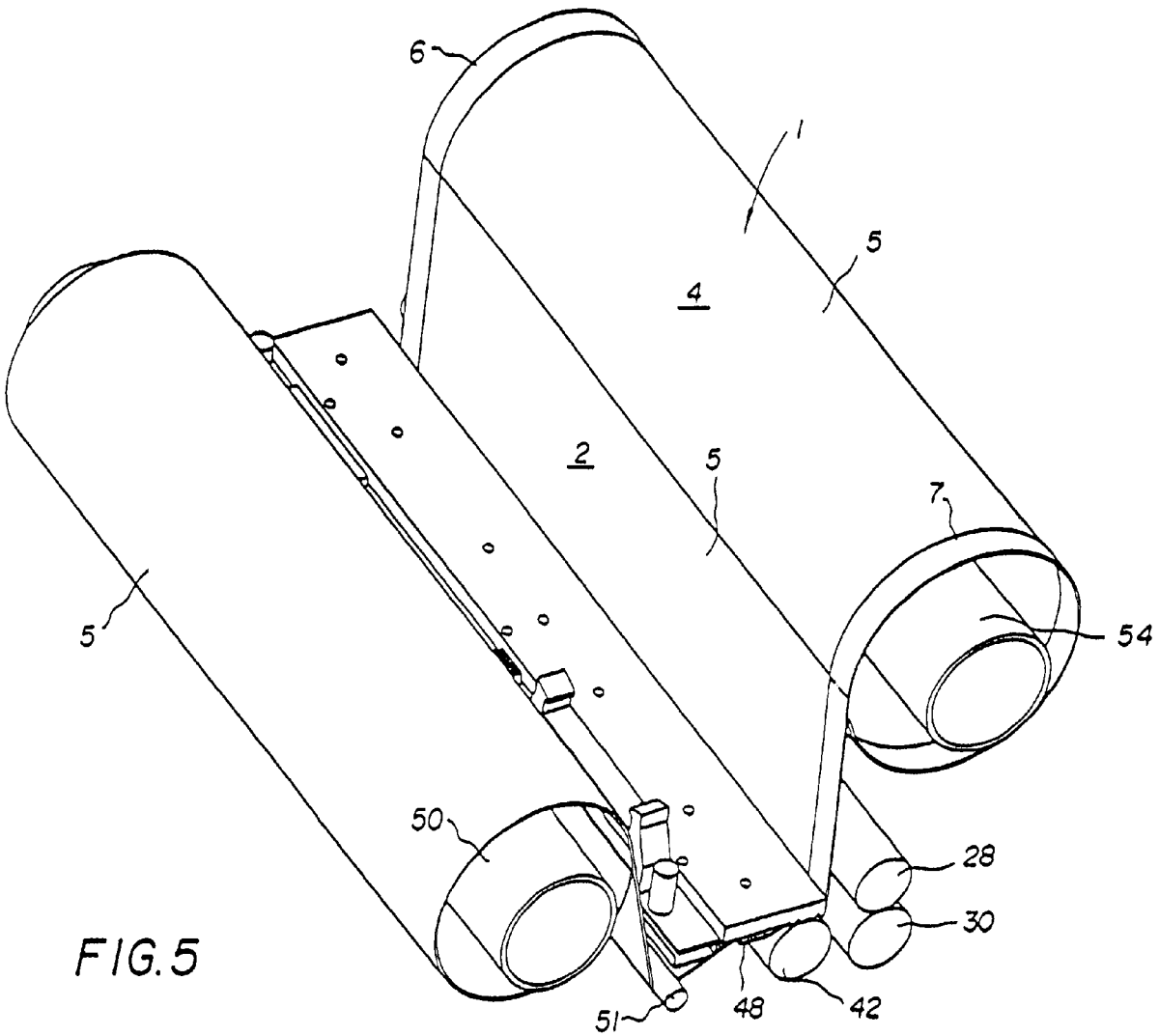
FIG. 5 is perspective view of a printing or dye transfer station in the dye transfer printer.

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together in a pressured relation between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a first stationary donor web guide bar 51, over the print head 48, and over a second stationary donor web guide bar or stripper 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable donor web cartridge 55 that is manually loaded into the printer 10.

Figure 7:
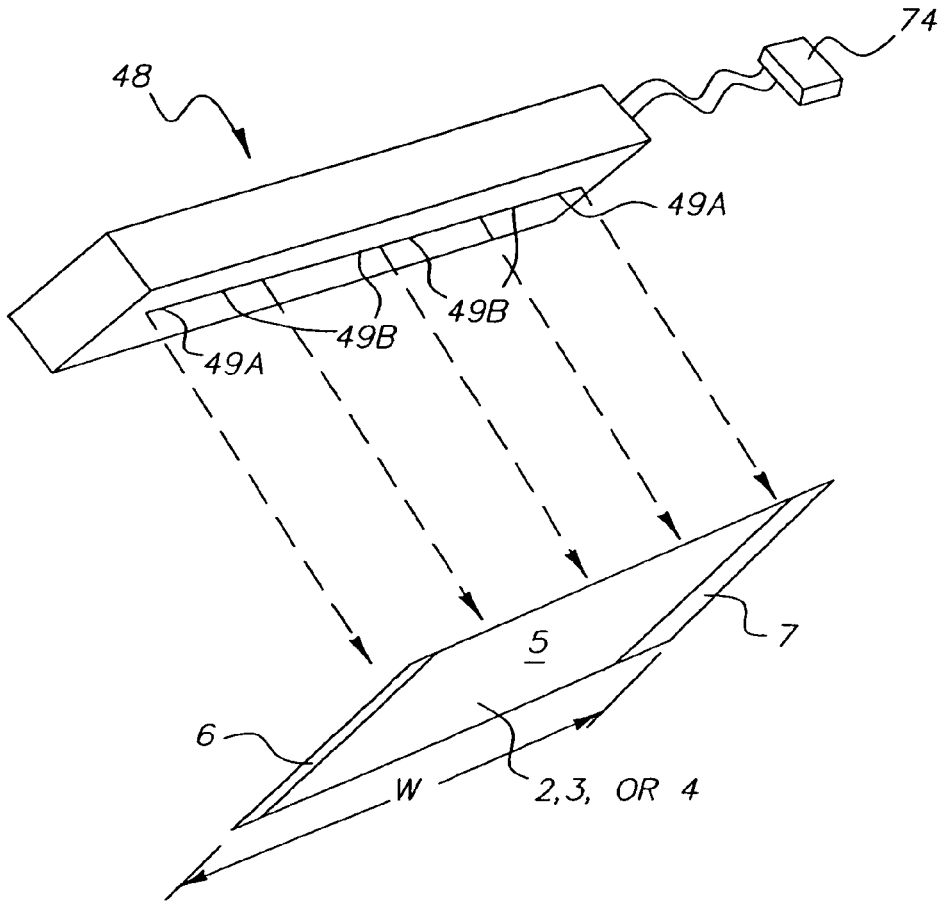
FIG. 7 is a perspective view of a linear array (bead) of selectively heated resistive elements on a thermal print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a linear array (bead) of selectively heated, closely spaced, resistive elements 49A, 49A, *, 49B, 49B, *, and 49A, 49A, *, on the print head 48 that make pressured print-line-contact across the entire width W of the yellow color section 2, i.e. across its dye transfer area 5 and the two edge areas 6 and 7 alongside the transfer area. As shown in FIG. 7, the resistive elements 49A make pressured contact with the edge areas 6 and 7 and the resistive elements 49B make similar contact with the dye transfer area 5. However, only the resistive elements 49B are selectively heated sufficiently to cause the yellow dye transfer from the dye transfer area 5 to the dye receiver sheet 12. The yellow dye transfer is done one line at a time, i.e. row-by-row, widthwise across the dye transfer area 5. The resistive elements 49A are not heated (or only slightly heated) so that there is no yellow dye transfer from the edge areas 6 and 7 to the dye receiver sheet 12**.

A known heat activating control 74, preferably including a suitably programmed microcomputer using known programming techniques, is connected individually to the resistive elements 49A, 49A, *, 49B, 49B, *, 49A, 49A, *, to selectively heat those resistive elements 49B that make pressured print-line-contact with the dye transfer area 5, and preferably not heat (or only slightly heat) those resistive elements 49A that make pressured contact with the two edge areas 6 and 7 alongside the dye transfer area. See FIG. 7**.

As the yellow color section 2 of the dye donor web 1 is used for dye transfer line-by-line, it is pulled forward from the print head 48 and over the second stationary donor web guide bar or stripper 52 in FIG. 4. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) cyan color section 4 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing (rear) edge 26 first, partially into the rewind chamber 40. See FIG. 3.

Final

Figure 6:
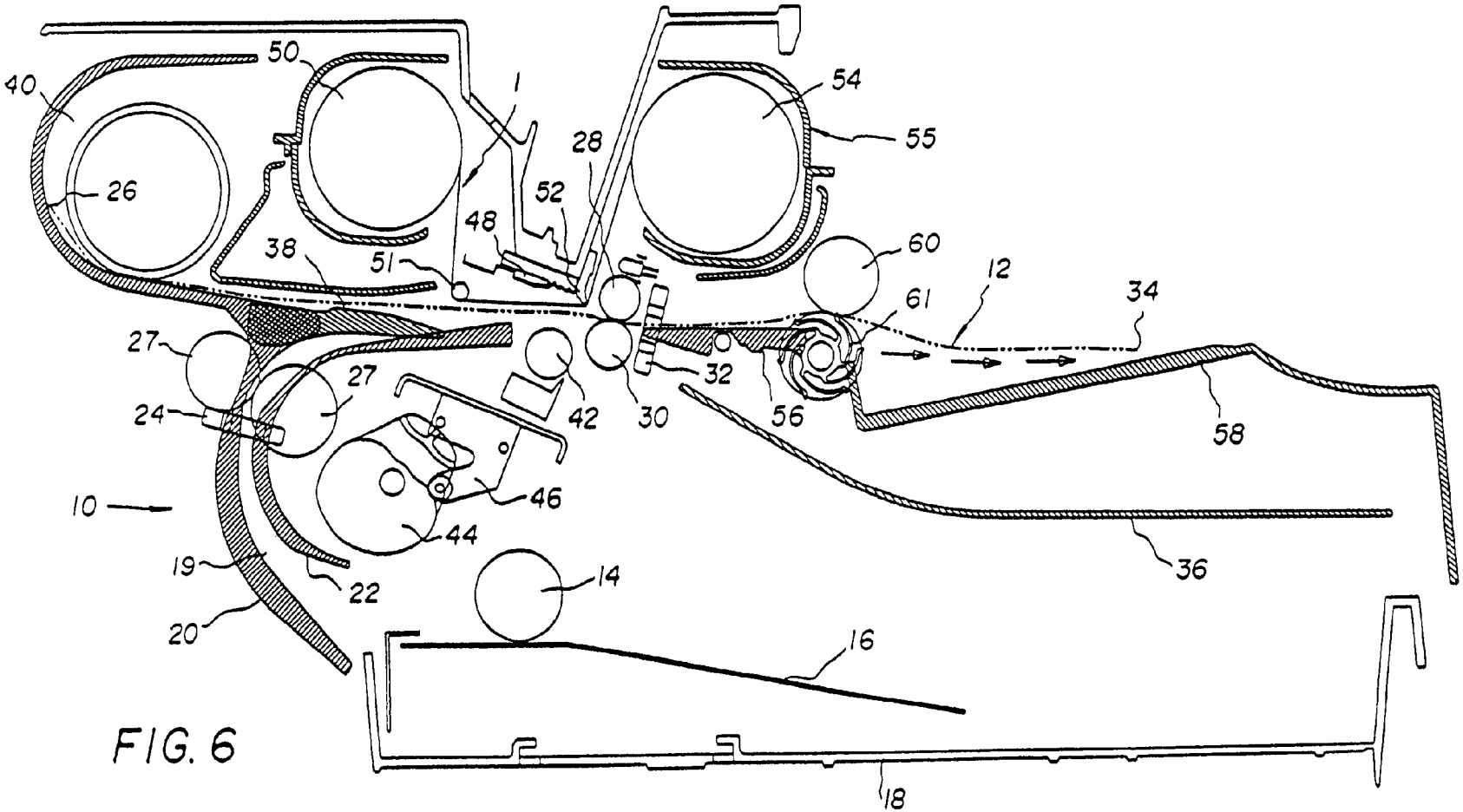
FIG. 6 is an elevation view, partly in section, of the dye transfer printer, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
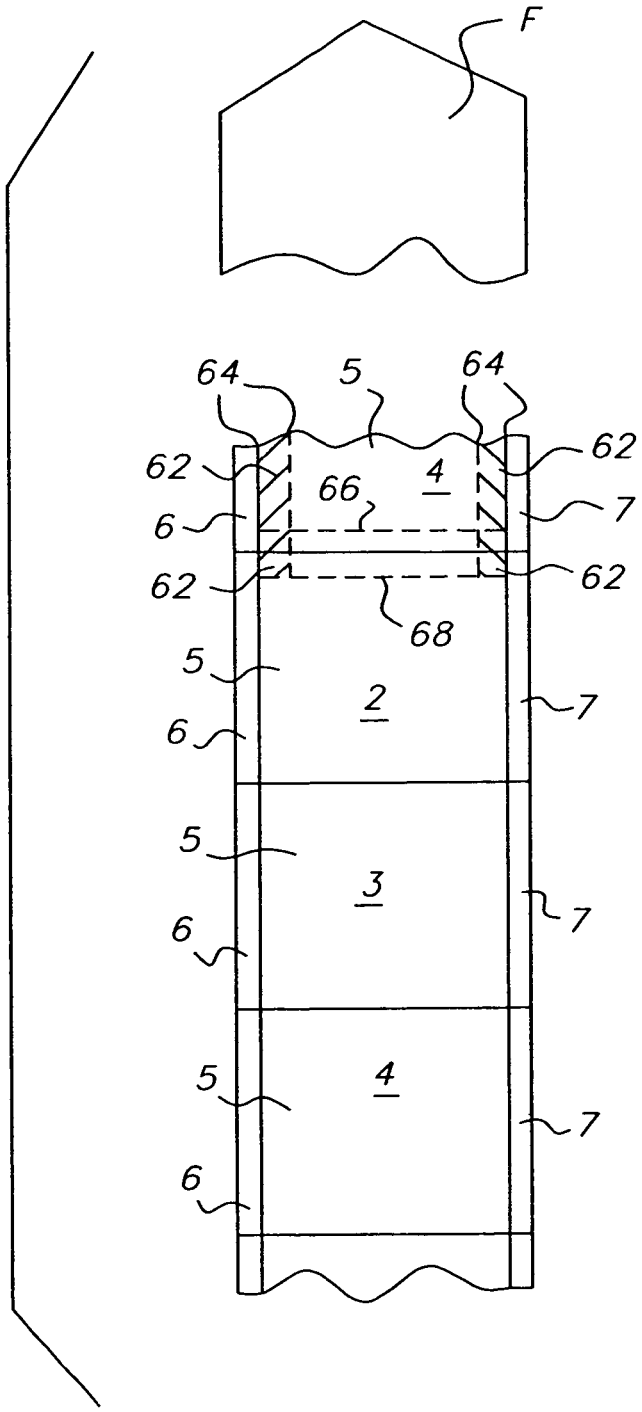
FIG. 8 (PRIOR ART)
FIG. 8 (PRIOR ART) is a plan view of a portion of the dye donor web, showing creases or wrinkles spreading rearward from a trailing (rear) end portion of a used dye transfer area into a leading (front) end portion of an unused dye transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the linear array (bead) of selectively heated resistive elements 49A, 49A, *, 49B, 49B, *, 49A, 49A, *, the color section is subjected to a longitudinal tension imposed substantially by a forward pulling force F of the motorized donor web take-up spool 54. See FIG. 8. Moreover, since the dye transfer area 5 is heated by the resistive elements 49B, but the two edge areas 6 and 7 alongside the dye transfer area are not heated by the resistive elements 49A, the dye transfer area is significantly weakened in relation to the two edge areas and therefore becomes more susceptible or vulnerable to being stretched than the two edge areas. See FIG. 7. Consequently, the longitudinal tension imposed by the forward pulling force F of the motorized take-up spool 54 can longitudinally stretch the dye transfer area 5 relative to the two edge areas 6 and 7. As is known, this stretching causes the dye transfer area 5 to become thinner than the non-stretched edge areas 6 and 7, which in turn causes slanted creases or wrinkles 62 to develop in the dye transfer area, most acutely in those regions 64 of the dye transfer area that are close to the two edge areas. See FIG. 8. The slanted creases or wrinkles 62 occur most acutely in the regions 64 of the dye transfer area 5 that are close to the two edge areas 6 and 7** because of the sharp, i.e. abrupt, transition between the weakened transfer area and the stronger edge areas.

Figure 9:
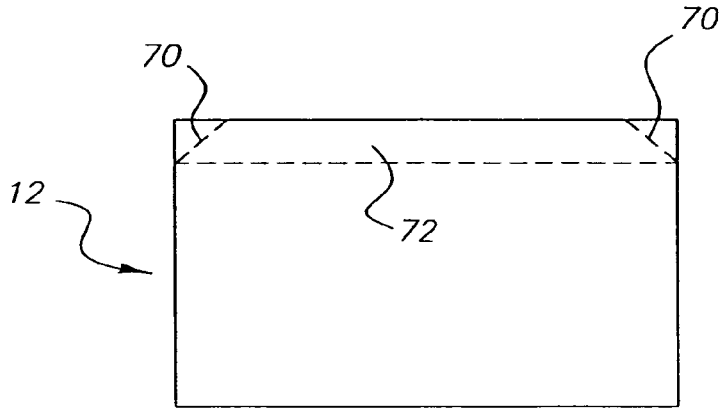
FIG. 9 (PRIOR ART)
FIG. 9 (PRIOR ART) is a plan view of a dye receiver sheet, showing line artifacts printed on a leading (front) edge portion of the dye receiver sheet.

As the dye donor web 1 is pulled by the motorized donor web take-up spool 54 over the linear array (bead) of selectively heated resistive elements 49A, 49A, *, 49B, 49B, *, 49A, 49A *, the slanted creases or wrinkles 62 tend to spread rearward from a trailing (rear) end portion 66 of a used dye transfer area 5 at least to a leading (front) end portion 68 of the next dye transfer area to be used. See FIG. 8. A problem that can result is that the slanted creases or wrinkles 62 in the leading or front end portion 68 of the next dye transfer area 5 to be used will cause undesirable line artifacts 70 to be printed on a leading (front) end portion 72 of the dye receiver sheet 12, when the dye transfer occurs at the creases in the leading end portion of the next transfer area to be used. See FIG. 9. The line artifacts 70 printed on the dye receiver sheet 12**, although they may be relatively short, are quite visible.

The question presented therefore is how to solve the problem of the slanted creases or wrinkles 62 being created in an unused transfer area 5 so that no line artifacts 70 are printed on the dye receiver sheet 12 during the dye transfer.

Solution

As previously mentioned, before each yellow, magenta or cyan dye transfer from a dye transfer area 5 to the dye receiver sheet 12, the platen roller 42 is shifted via the rotated cam 44 and the platen lift 46 to adjacent the print head 48. This causes both the dye receiver sheet 12 and an unused yellow, magenta or cyan color section 2, 3 or 4 (comprising a dye transfer area 5 and two edge areas 6 and 7) of the donor web 1 to be intimately held together between the platen roller 42 and the print head 48. The platen roller 42 shown in FIGS. 2–6 is an ordinary cylindrical (uniform diameter) roller and, as such, it is substantially ineffective to prevent the slanted creases 62 from forming in the dye transfer area 5, including in the regions 64 of the dye transfer area that are close to the two edge areas 6 and 7, during the dye transfer. See FIG. 8.

Figure 11:
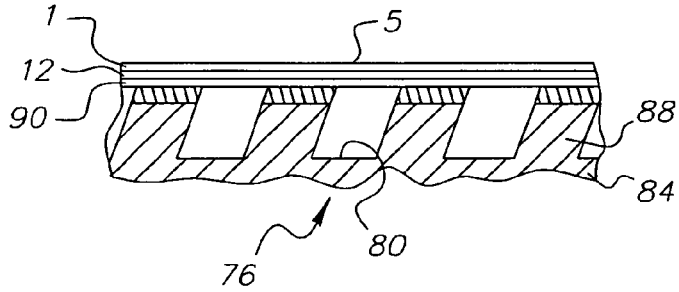
FIG. 11 is an enlarged view of a portion of the crease-preventing web roller in FIG. 10.
Figure 10:
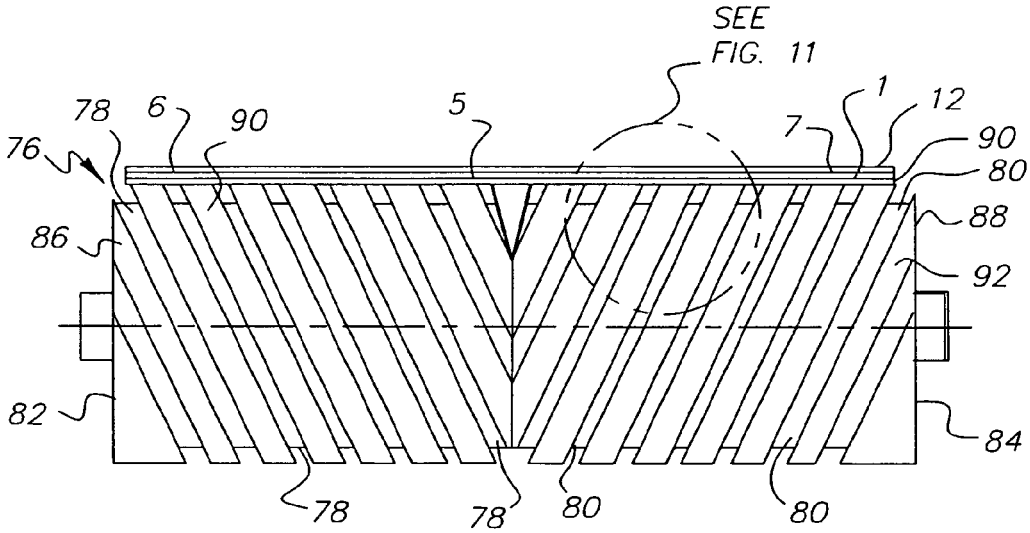
FIG. 10 is an elevation view of a crease-preventing web roller that is intended to be used in the dye transfer printer according to a preferred embodiment of the invention.
Figure 12:
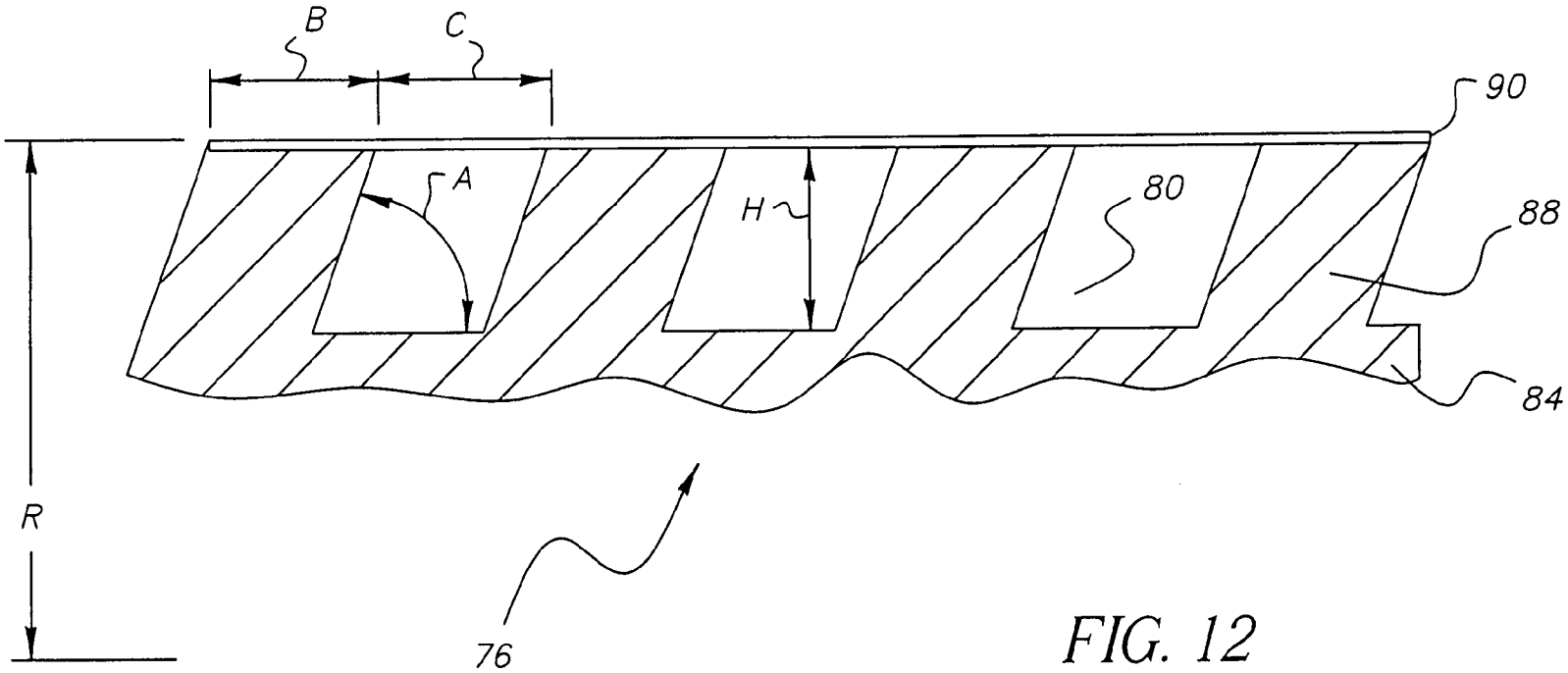
FIG. 12 is a further enlargement of the portion of the crease-preventing platen roller in FIG. 11.

According to a preferred embodiment of the invention, FIGS. 10–12 show a crease-preventing web roller 76 that prevents the slanted creases 62 from forming in the dye transfer area 5, including in the regions 64 of the dye transfer area that are close to the two edge areas 6 and 7, during the dye transfer.

The crease-preventing roller 76 can be used in place of the platen roller 42 or the donor web guide bar 51 in FIGS. 2–6. Alternatively, it can be positioned between the platen roller 48 and the donor web guide 51 in FIGS. 2–6.

The crease-preventing roller 76 has opposed helical grooves 78 and 80 that are spiraled inwardly in respective directions from coaxial opposite ends 82 and 84 of the roller to form resilient helical ribs or projections 86 and 88. The helical ribs 86 and 88 meet midway between the roller ends 82 and 84 and they are covered with a single, cylindrical, elastic cover layer 90. The elastic cover layer 90 is secured to the helical ribs 86 and 88.

As indicated in FIGS. 10–12, the helical ribs 86 jut out to be inclined towards the roller end 82, and the helical ribs 88 jut out to be inclined towards the roller end 84. The helical ribs 86 are each inclined an acute angle A towards the roller end 82, and the helical ribs 88 are each inclined the same angle A towards the roller end 84. Preferably, the acute angle A is within the range of 60°–85°. Also, the helical ribs 86 and 88 have the same width B. Preferably, the width B of the helical ribs 86 and 88 divided by the radius R of the crease-preventing roller 76 is within the range of 0.1–0.5, i.e. 10%–50%. Similarly, the helical grooves 78 and 80 have the same width C, and the width of the helical grooves divided by the radius R of the cease-preventing roller 76 preferably is within the range of 0.1–0.5, i.e. 10%–50%. The helical ribs 86 and 88 have the same height H. Preferably, the height H of the helical ribs 86 and 88 divided by the radius R of the crease-preventing roller 76 is within the range of 0.1–0.25, i.e. 10%–25%.

Figure 13:
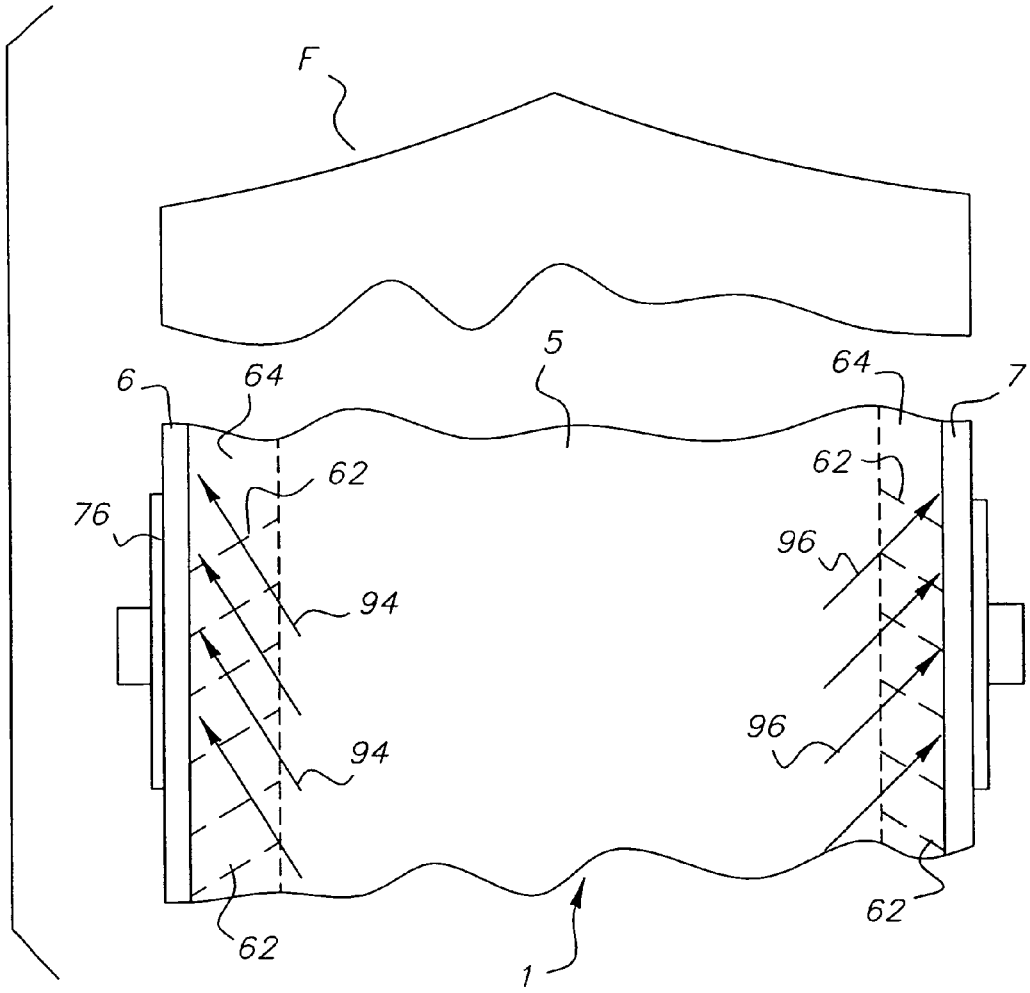
FIG. 13 is a plan view of a longitudinal portion of the dye donor web, depicting how the crease-preventing platen roller in FIGS. 10–12 operates to prevent crease formation.

During the dye transfer, the helical ribs 86 and 88 are temporarily deformed or bent towards the opposite roller ends 82 and 84 by the longitudinal tensioning of the dye transfer area 5 and two edge areas 6 and 7 at the print head 48. Such longitudinal tensioning is imposed by the forward pulling force F of the motorized take-up spool 54. The helical ribs 86 and 88, when deflected towards the roller ends 82 and 84, cause the elastic cover layer 90 to be stretched towards the roller ends. In turn, the elastic cover layer, when stretched, causes at least the regions 64 of the dye transfer area 5 in which the slanted creases 62 can form to spread in opposition to crease formation, so that the line artifacts 70, shown in FIG. 9, will not be printed on the dye receiver sheet 12 as in the prior art. More specifically, in FIG. 13, the deflected ribs 86 and 88 (not shown) in concert with the stretched cover layer 90 act to diagonally urge the dye donor web 1, including the two edge areas 6 and 7 and at least the adjacent regions 64, 64, in web spreading directions 94 and 96 to oppose crease formation.

The elastic cover layer 90 is an elastomeric material having a modulus of elasticity preferably within the range of 1 Mega Pascal ($1\times10^6$ Pascal)-20 Mega Pascal ($20\times10^6$ Pascal) and a hardness preferably within the range of 20 Shore A–90 Shore A. The elastomer material preferably can be constructed of either styrene-butadiene rubber, polyisoprene rubber, polybutadiene rubber, silicon rubber, ethylene-propylene rubber, urethane rubber, or fluorocarbon rubber.

Figure 14:
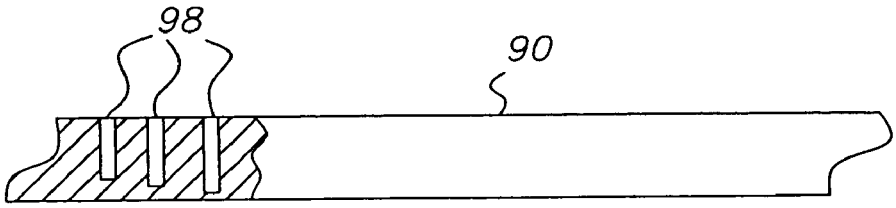
FIG. 14 is a cross-section view of a portion of an elastic cover layer on the crease-preventing roller, according to a first alternate embodiment of the invention.
Figure 15:
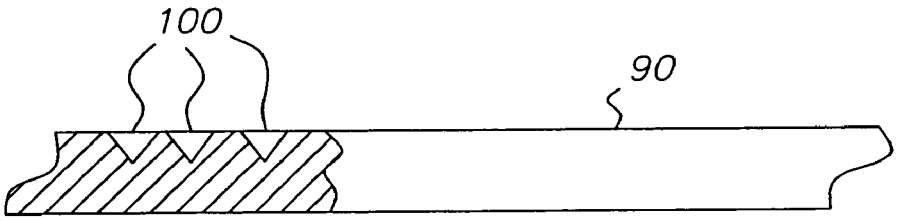
FIG. 15 is a cross-section view of a portion of the elastic cover layer on the crease-preventing roller, according to a second alternate embodiment of the invention.
Figure 16:
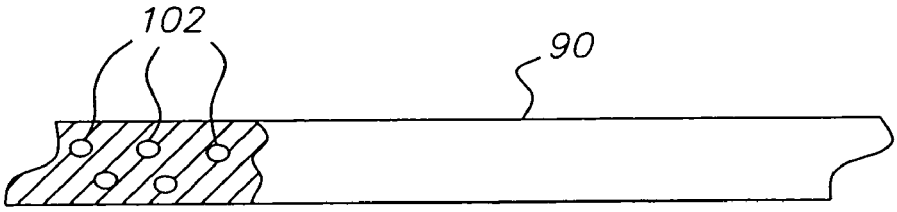
FIG. 16 is a cross-section view of a portion of the elastic cover layer on the crease-preventing roller, according to a third alternate embodiment of the invention.

FIG. 14 is a cross-section view of a portion of the elastic cover layer 90 according to a first alternate embodiment. In this instance, the elastic cover layer 90 has perforations 98 to facilitate it being stretched by the helical ribs 86 and 88. FIG. 15 is a cross-section view of a portion of the elastic cover layer 90 according to a second alternate embodiment. In this instance, the elastic cover layer 90 has surface holes 100 to facilitate it being stretched by the helical ribs 86 and 88. FIG. 16 is a cross-section view of a portion of the elastic cover layer 90 according to a third alternate embodiment. In this instance, the elastic cover layer 90 has encapsulated microspheres 102 to facilitate it being stretched by the helical ribs 86 and 88. The microspheres 102 contain a soft filler which is softer than the elastic cover layer 90.

The invention has been described in detail with particular reference to certain preferred and alternate embodiments thereof, but it will be understood that variations and modifications can be effected within the spirit and scope of the invention. For example, the crease-preventing roller 76 instead of being used in place of the platen roller 42 in FIGS. 2–6, can be used as a substitute for the first stationary donor web guide 51. In this case, the crease-preventing roller 76 only supports the dye donor web 1 (and not the dye receiver sheet 12).

PARTS LIST

| | |
|---|---|
| 1. | dye donor web |
| 2. | yellow color section |
| 3. | magenta color section |
| 4. | cyan color section |
| 5. | dye transfer area |
| 6. | longitudinal edge area |
| 7. | longitudinal edge area |
| W. | dye donor web width |
| 10. | thermal dye transfer printer |
| 12. | dye receiver sheet |
| 14. | pick rollers |
| 16. | platen |
| 18. | tray |
| 19. | channel |
| 20. | longitudinal guide |
| 22. | longitudinal guide |
| 24. | trailing edge sensor |
| 26. | trailing edge |
| 27. | urge rollers |
| 28. | capstan roller |
| 30. | pinch roller* |
| 32. | leading edge sensor |
| 34. | leading or front edge |
| 36. | intermediate tray |
| 38. | exit door |
| 40. | rewind chamber |
| 42. | platen roller |
| 44. | cam |
| 46. | platen lift |
| 48. | thermal print head |
| 49A, 49B. | linear array (bead) of resistive elements |
| 50. | donor web supply spool |
| 51. | first stationary (fixed) donor web guide |
| 52. | second stationary (fixed) donor web guide |
| 54. | donor web take-up spool |
| 55. | donor web cartridge |
| 56. | diverter |
| 58. | exit tray |
| 60. | exit roller |
| 61. | exit roller |
| F. | forward pulling force |
| 62. | slanted creases or wrinkles |
| 64. | donor web regions |
| 66. | trailing or rear end portion |
| 68. | leading or front end portion |
| 70. | line artifacts |
| 72. | leading or front end portion |
| 74. | heat activating control |
| 76. | crease-preventing web roller |
| 78. | helical groove |
| 80. | helical groove |
| 82. | roller end |
| 84. | roller end |
| 86. | helical rib or projection |
| 88. | helical rib or projection |
| 90. | elastic cover layer |
| A. | rib angle |
| B. | rib width |
| R. | roller radius |
| C. | groove width |
| H. | rib height |
| 94. | web spreading direction |
| 96. | web spreading direction |

-continued

PARTS LIST

| | |
|---|---|
| 98. | perforations |
| 100. | surface holes |
| 102. | microspheres |

The invention claimed is:

1. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and a crease-preventing roller for supporting at least the dye transfer area and two edge areas, having an elastic cover layer that can be stretched towards coaxial opposite ends of said roller to spread at least the regions of the dye transfer area in which crease formation can occur in order to oppose crease formation, and having respective movable members moving to stretch said elastic cover layer towards said opposite ends of said roller.

2. A thermal printer as recited in claim 1, wherein a donor web take-up exerts a pulling force on the dye transfer area and two edge areas at said print head which longitudinally tensions the dye transfer area and two edge areas, and said movable members move to stretch said elastic cover layer towards said opposite ends of said roller in response to longitudinally tensioning the dye transfer area and two edge areas.

3. A method in a thermal printer of preventing crease formation in successive dye transfer areas of a dye donor web that can cause line artifacts to be printed on a dye receiver during dye transfer from each dye transfer area to the dye receiver, said method comprising:

heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and stretching an elastic cover layer on a crease-preventing roller that supports at least the dye transfer area and two edge areas towards coaxial opposite ends of the roller, so that the elastic cover layer spreads at least the regions of the dye transfer area in which crease formation can occur in order to oppose crease formation.

4. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and a crease-preventing roller for supporting at least the dye transfer area and two edge areas, having respective projections that can be deformed towards coaxial opposite ends of said roller, and having an elastic cover layer over said projections that is stretched towards said opposite ends of said roller by said projections being deformed towards said opposite ends of said roller, whereby said elastic cover layer spreads at least the regions of the dye transfer area in which crease formation can occur in order to oppose crease formation.

5. A thermal printer capable of preventing crease formation in successive dye transfer areas of a dye donor web that can cause line artifacts to be printed on a dye receiver during dye transfer from each dye transfer area to the dye receiver, said printer comprising:

a thermal print head for heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that the dye transfer area is vulnerable to being longitudinally stretched relative to the two edge areas to possibly cause crease formation at least in respective regions of the dye transfer area adjacent the two edge areas;

a donor web take-up that exerts a pulling force on the dye transfer area and two edge areas at said print head which longitudinally tensions the dye transfer area and two edge areas, to tend to longitudinally stretch the dye transfer area relative to the two edge areas; and a crease-preventing roller for supporting at least the dye transfer area and two edge areas, having respective projections that are resilient to be deformed towards coaxial opposite ends of said roller when said donor web take-up longitudinally tensions the dye transfer area and two edge areas, and having an elastic cover layer over said projections that is stretched towards said opposite ends of said roller by said projections being deformed towards said opposite ends of said roller, whereby said elastic cover layer spreads at least the regions of the dye transfer area in which crease formation can occur in order to oppose crease formation.

6. A thermal printer as recited in claim 5, wherein said elastic cover layer is an elastomeric material having a modulus of elasticity within the range of 1 Mega Pascal–20 Mega Pascal.

7. A thermal printer as recited in claim 6, wherein said elastomeric material has a hardness within the range of 20 Shore A-90 Shore A.

8. A thermal printer as recited in claim 5, wherein said elastic cover layer is an elastomeric material constructed of either styrene-butadiene rubber, polyisoprene rubber, polybutadiene rubber, silicon rubber, ethylene-propylene rubber, urethane rubber, or fluorocarbon rubber.

9. A thermal printer as recited in claim 5, wherein said elastic cover layer is perforated to facilitate it being stretched when said projections are deformed.

10. A thermal printer as recited in claim 5, wherein said elastic cover layer has surface holes to facilitate it being stretched when said projections are deformed.

11. A thermal printer as recited in claim 5, wherein said elastic cover layer has encapsulated microspheres containing soft material that is softer than said elastic cover layer to facilitate said elastic cover layer being stretched when said projections are deformed.

12. A thermal printer as recited in claim 5, wherein said respective projections jut out an acute angle to be inclined at the acute angle towards said opposite ends of said roller in order to facilitate said projections being deformed towards said opposite ends of said roller when said donor web take-up longitudinal tensions the dye transfer area and two edge areas.

13. A thermal printer as recited in claim 12, wherein said respective projections are helical ribs that spiral inwardly from said opposite ends of said roller in addition to jutting out at the acute angle.

14. A thermal printer as recited in claim 5, wherein said crease-preventing roller is a platen roller that is movable to press the dye receiver against the dye transfer area and two edge areas and in turn press the dye transfer area and two edge areas against said print head to permit dye transfer from the dye transfer area to the dye receiver.

15. A method in a thermal printer of preventing crease formation in successive dye transfer areas of a dye donor web that can cause line artifacts to be printed on a dye receiver during dye transfer from each dye transfer area to the dye receiver, said method comprising:

heating a dye transfer area of the dye donor web sufficiently to effect dye transfer from the dye transfer area to the dye receiver, but not heating two opposite edge areas of the dye donor web alongside the dye transfer area sufficiently to allow dye transfer from the two edge areas to the dye receiver, so that crease formation can occur at least in respective regions of the dye transfer area adjacent the two edge areas; and deforming towards coaxial opposite ends of a crease-preventing roller that supports at least the dye transfer area and two edge areas, respective projections on the roller, to stretch an elastic cover layer on the projections towards the opposite ends of the roller, whereby the elastic cover layer spreads at least the regions of the dye transfer area in which crease formation can occur in order to oppose crease formation.

* * * * *